US007731025B2

(12) United States Patent
Cheng et al.

(10) Patent No.: US 7,731,025 B2
(45) **Date of Patent: *Jun. 8, 2010**

(54) PACKAGING CUSHION ASSEMBLY

(75) Inventors: Sheng-Hsiung Cheng, Taipei Hsien (TW); Te-An Lin, Taipei Hsien (TW); Wu-Nan Wang, Taipei Hsien (TW); Chia-Chia Huang, Taipei Hsien (TW)

(73) Assignee: Aopen Inc., Taipei Hsien (TW)

( * ) Notice: Subject to any disclaimer, the term of this patent is extended or adjusted under 35 U.S.C. 154(b) by 184 days.

This patent is subject to a terminal disclaimer.

(21) Appl. No.: 11/849,789

(22) Filed: Sep. 4, 2007

(65) Prior Publication Data

US 2008/0105591 A1 May 8, 2008

(30) Foreign Application Priority Data

Nov. 6, 2006 (TW) ..... 95140969 A

(51) Int. Cl.
*B65D 85/00* (2006.01)
*B65D 5/00* (2006.01)

(52) U.S. Cl. ..... 206/320; 206/521

(58) Field of Classification Search ..... 206/320, 206/521, 588, 736, 523, 586, 591, 594, 784; 229/177–179, 165, 167

See application file for complete search history.

(56) References Cited

U.S. PATENT DOCUMENTS 2,148,048 A * 2/1939 Gray ..... 229/120.01
2,684,194 A * 7/1954 Frankenstein ..... 229/167
2,963,210 A * 12/1960 Gillmore, Sr. ..... 229/178
3,499,597 A * 3/1970 Katzman ..... 206/525
3,701,465 A * 10/1972 Richter ..... 206/521
4,770,339 A * 9/1988 Weimer ..... 229/143
4,802,619 A * 2/1989 Laido ..... 229/125.19
5,967,407 A * 10/1999 Mueller ..... 229/125.19
5,996,885 A * 12/1999 Chu ..... 229/179

FOREIGN PATENT DOCUMENTS

TW 81212609 9/1992

* cited by examiner

*Primary Examiner*—Mickey Yu
*Assistant Examiner*—Steven A. Reynolds
(74) *Attorney, Agent, or Firm*—Stephen A. Bent; Foley & Lardner LLP

(57) ABSTRACT

A packaging cushion assembly includes at least one foldable packaging plate including a base plate that has two opposite first sides, two opposite second sides, two opposite first side plates connected respectively and foldably to the first sides, and two opposite second side plates connected respectively and foldably to the second sides. Each of the first and second side plates has an outer wall plate section connected foldably to the respective first or second side, a spacer plate section connected foldably to the outer wall plate section, and an inner wall plate section connected foldably to the spacer plate section. The outer wall plate section of each second side plate has two connecting plates respectively and foldably connected to two ends thereof.

7 Claims, 6 Drawing Sheets

PACKAGING CUSHION ASSEMBLY

CROSS-REFERENCE TO RELATED APPLICATION

This application claims priority of Taiwanese Application No. 095140969, filed on Nov. 6, 2006.

BACKGROUND OF THE INVENTION

1. Field of the Invention

The invention relates to a packaging cushion assembly, more particularly to a packaging cushion assembly that can be folded so as to form a receiving space, that can be unfolded so as to save space, and that can be recycled.

2. Description of the Related Art

Referring to FIG. 1, a currently available packaging cushion assembly 100 is used on top and bottom portions 140, 141 of an assembled computer module 14 to protect the computer module 14 from damage due to impact during transport. The packaging cushion assembly 100 includes a pair of unitary frame bodies 1 each made of a foam material. Each of the frame bodies 1 has a bottom wall 10, and four sidewalls 12 extending perpendicularly and respectively from four end peripheries 11 of the bottom wall 10. The bottom wall 10 and the sidewalls 12 cooperatively define a receiving space 13. During packing, the frame bodies 1 respectively and directly cover top and bottom portions 140, 141 of an article, such as the computer module 14, through the receiving spaces 13 thereof so as to protect the computer module 14 from damage due to impact during transport.

Since each frame body 1 of the packaging cushion assembly 100 is formed as a unitary body from foam material, the frame body 1 cannot be folded so that it occupies a substantial space during transport.

SUMMARY OF THE INVENTION

Therefore, the object of the present invention is to provide a packaging cushion assembly that can be unfolded to save space during transport.

According to this invention, a packaging cushion assembly comprises at least one foldable packaging plate including a base plate that has two opposite first sides and two opposite second sides, two opposite first side plates connected respectively and foldably to the first sides, and two opposite second side plates connected respectively and foldably to the second sides. Each of the first side plates has a first outer wall plate section connected foldably to the respective one of the first sides of the base plate, a first spacer plate section connected foldably to the first outer wall plate section opposite to the base plate, and a first inner wall plate section connected foldably to the first spacer plate section opposite to the first outer wall plate section and having substantially the same width as the first outer wall plate section. Each of the second side plates has a second outer wall plate section connected foldably to the respective one of the second sides of the base plate, a second spacer plate section connected foldably to the second outer wall plate section opposite to the base plate, and a second inner wall plate section connected foldably to the second spacer plate section opposite to the second outer wall plate section and having substantially the same width as the second outer wall plate section. The second outer wall plate section of each of the second side plates has two ends that are opposite along a respective one of the second sides, and two connecting plates respectively and foldably connected to the two ends. Each of the connecting plates has a third outer wall plate section connected foldably to the second outer wall plate section, a third spacer plate section connected foldably to the third outer wall plate section opposite to the second outer wall plate section, and a third inner wall plate section connected foldably to the third spacer plate section opposite to the third outer wall plate section.

BRIEF DESCRIPTION OF THE DRAWINGS

Other features and advantages of the present invention will become apparent in the following detailed description of the preferred embodiments with reference to the accompanying drawings, of which.

DETAILED DESCRIPTION OF THE PREFERRED EMBODIMENT

Figure 2:
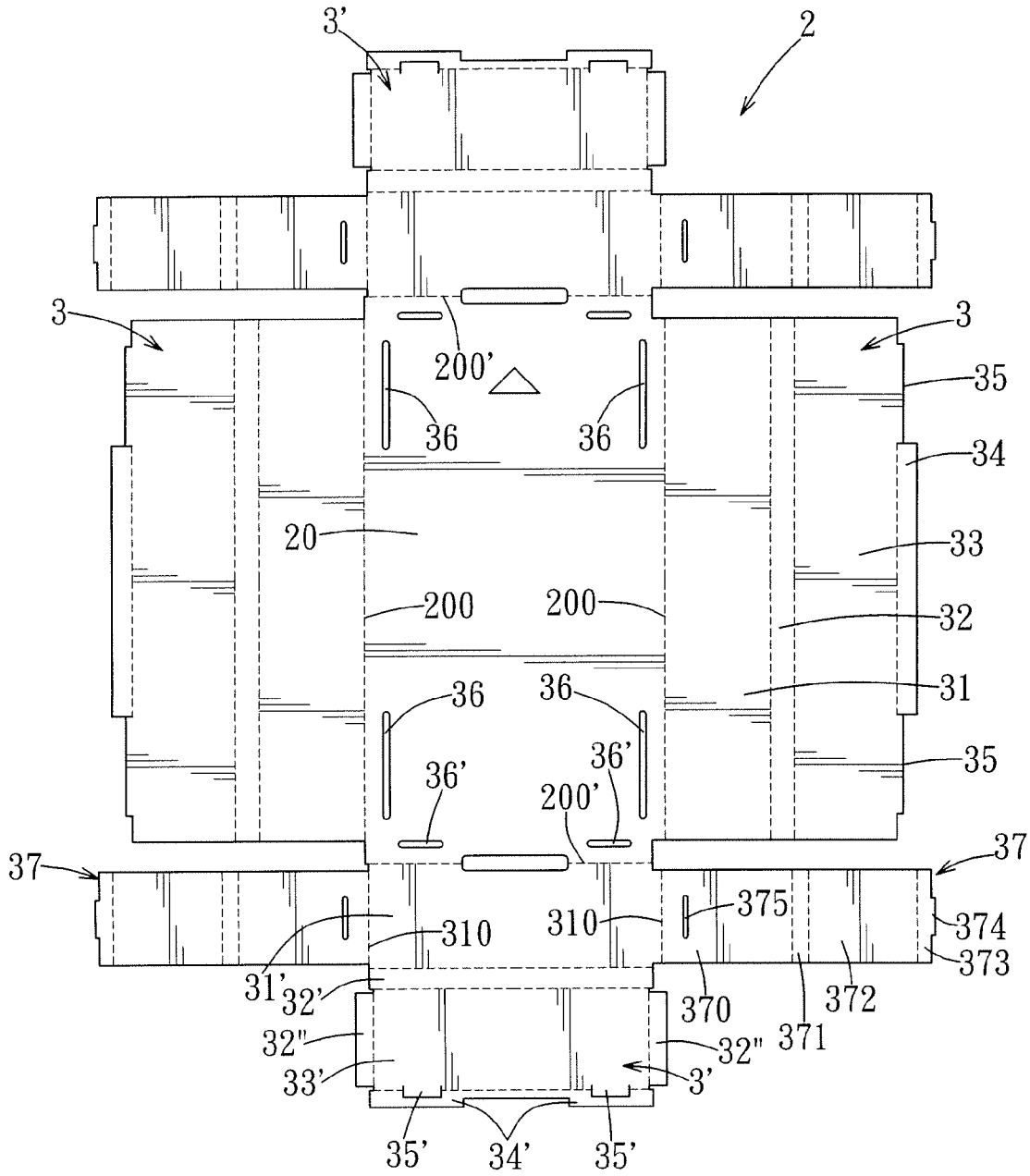
FIG. 2 is a schematic view of a preferred embodiment of an unfolded packaging plate of a packaging cushion assembly according to the present invention.
Figure 3:
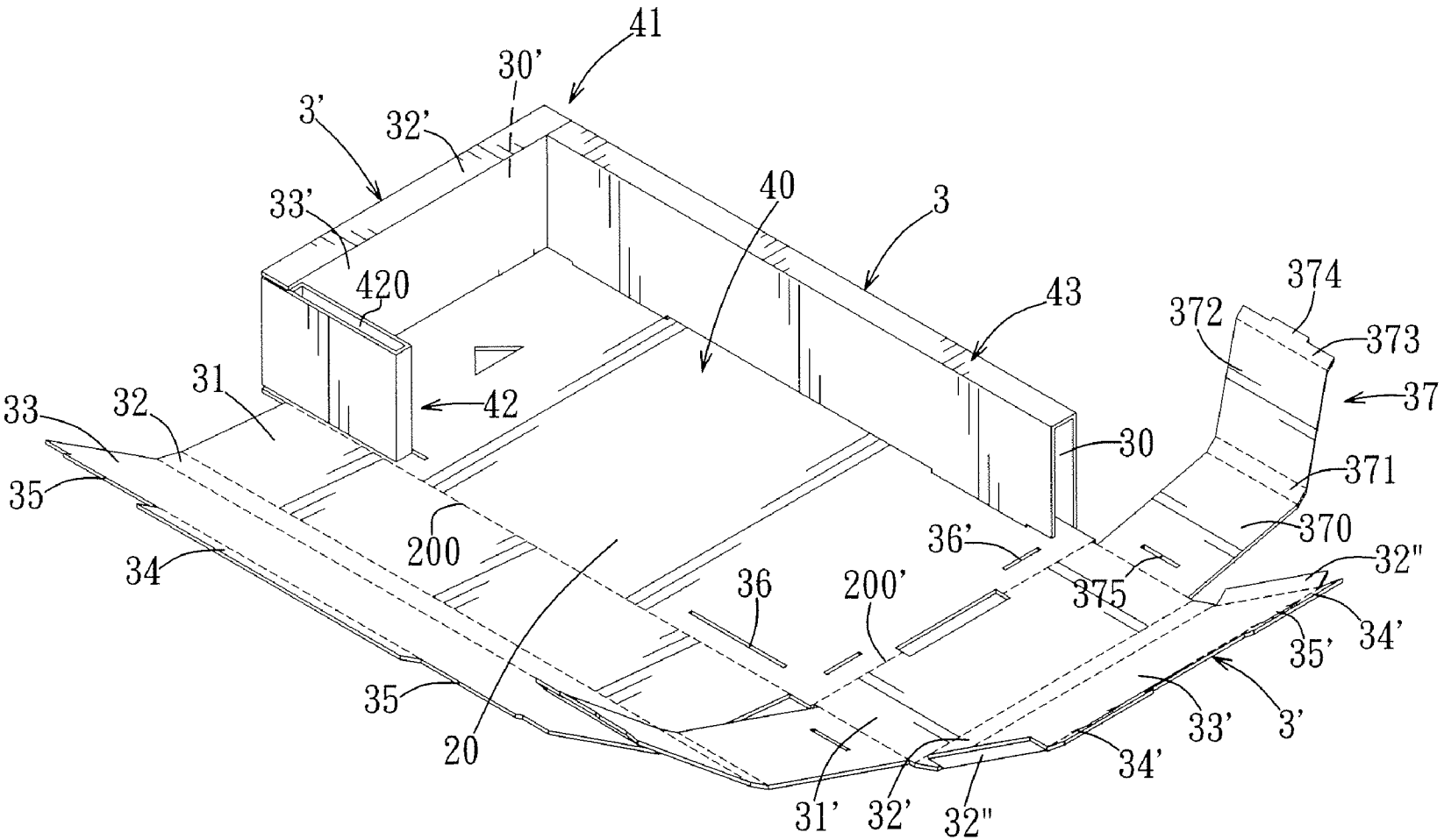
FIG. 3 shows the packaging plate of FIG. 2 in a partially folded state.
Figure 4:
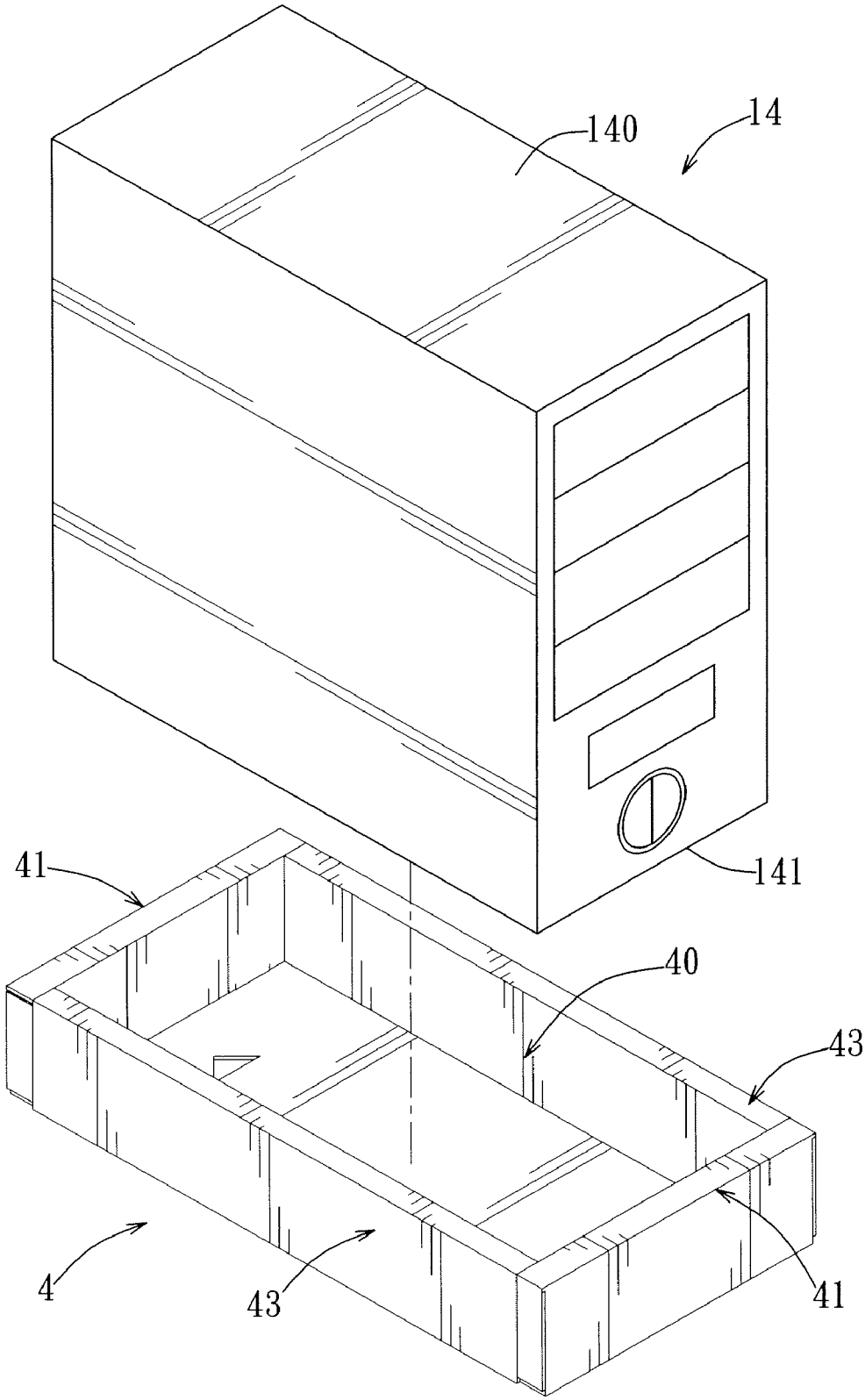
FIG. 4 shows the packaging plate of FIG. 2 in a completely folded state.

Referring to FIGS. 2 to 4, the preferred embodiment of a packaging cushion assembly according to the present invention is shown to comprise a packaging plate 2 which can be unfolded so as to save space and which can be recycled. The packaging plate 2 is a corrugated paper packaging plate, and has a base plate 20, and four side plates 3, 3' connected respectively to four sides 200, 200' of the base plate 20. Each of the side plates 3, 3' is foldable relative to the base plate 20 to move to a folded position so as to form a buffering space 30, 30'. The base plate 20 and the folded side plates 3, 3' cooperatively define an embracing space 40 to embrace a top or bottom portion 140, 141 of an article, such as a computer module 14. The buffering spaces 30, 30' of the side plates 3, 3' serve as cushions to protect the computer module 14 from damage during transport. In this embodiment, the four sides 200, 200' of the base plate 20 include a pair of first sides 200 and a pair of second sides 200'. The side plates 3, 3' include two opposite first side plates 3 connected respectively and foldably to the first sides 200, and two opposite second side plates 3' connected respectively and foldably to the second sides 200'. The four sides 200, 200' of the base plate 20 may have different lengths as shown or may have the same length. It is necessary only that the base plate 20, which determines the lengths of the sides 200, 200', matches the shape of a top or bottom portion of an article to be covered.

Each of the first side plates 3 has a first outer wall plate section 31 connected foldably to the respective first side 200, a first spacer plate section 32 connected foldably to the first outer wall plate section 31 opposite to the respective first side 200, a first inner wall plate section 33 connected foldably to the first spacer plate section 32 opposite to the first outer wall plate section 31 and having substantially the same width as the first outer wall plate section 31, and a first press plate section 34 connected to the first inner wall plate section 33 opposite to the first spacer plate section 32. Each first side plate 3 further has two first fastening tongues 35 projecting outwardly from the first inner wall plate section 33 and located respectively on two opposite sides of the first press plate section 34. Two pairs of spaced-apart first insert holes 36 are formed in the base plate 20 and are spaced apart from the respective first sides 200 to correspond in position to the first fastening tongues 35 when the first side plates 3 are folded.

Each of the second side plates 3' has a second outer wall plate section 31' connected foldably to the respective second side 200', a second spacer plate section 32' connected foldably to the second outer wall plate section 31' opposite to the second side 200', a second inner wall plate section 33' connected foldably to the second spacer plate section 32' opposite to the second outer wall plate section 31' and having substantially the same width as the second outer wall plate section 31', and left and right press plate sections 34' connected to the second inner wall plate section 33' and spaced apart from each other at an appropriate distance. The juncture of the second inner wall plate section 33' and the corresponding second press plate section 34' is provided with a cut to form a second fastening tongue 35' that projects outwardly from the second inner wall plate 33'. Two pairs of spaced-apart second insert holes 36' are formed in the base plate 20 and are spaced apart from the respective second sides 200' to correspond in position to the second fastening tongues 35' when the second side plates 3' are folded.

The difference between the first and second side plates 3, 3' resides in that the second inner wall plate section 33' of each second side plate 3' has two end wings 32" connected respectively to two opposite ends of the respective second inner wall plate section 33' thereof, and that the second outer wall plate section 31' of each second side plate 3' has two connecting plates 37 respectively and foldably connected to two opposite ends 310 thereof and elongated in the same direction as the respective second inner wall plate section 31'. Each of the connecting plates 37 has a third outer wall plate section 370 connected foldably to the respective second outer wall plate section 31', a third spacer plate section 371 connected foldably to the third outer wall plate section 370 opposite to the respective second outer wall plate section 31', a third inner wall plate section 372 connected foldably to the third spacer plate section 371 opposite to the third outer wall plate section 370, a third press plate section 373 connected to the third inner wall plate section 372 opposite to the third spacer plate section 371, and a third fastening tongue 374 projecting out of the third press plate section 373. The third outer wall plate section 370 of each connecting plate 37 is formed with an aperture 375 that is proximate to the second outer wall plate section 31' and that corresponds in position to the third fastening tongue 374 when the connecting plate 37 is folded.

With reference to FIGS. 3 and 4, the first and second side plates 3, 3' of the packaging plate 2 are folded to form a packaging cushion 4 that confines the embracing space 40 and that has four hollow side panels 41, 43 confining the buffering spaces 30', 30, respectively. Each hollow side panel 41 is formed by bending the respective second outer wall plate section 31', the respective second spacer plate section 32', the respective second inner wall plate section 33', and the respective left and right press plate sections 34' relative to each other at right angles and by inserting the respective second fastening tongue 35' into the respective insert hole 36'. Each buffering space 30' is defined by the respective second outer wall plate section 31', the respective second spacer plate section 32', the respective second inner wall plate section 33', and the respective left and right press plate sections 34', and the respective end wings 32" are bent at right angles to close the buffering space 30'.

The third outer wall plate section 370, the third inner spacer plate section 371, the third inner wall plate section 372, and the third press plate section 373 of each connecting plate 37 are folded relative to each other substantially at right angles, and the fastening tongue 374 of each connecting plate 37 is inserted into the respective aperture 375. As such, the connecting plates 37 of each second side plate 3' are formed respectively into connecting walls 42. The connecting walls 42 are freely turnable relative to the respective side panels 41 and define buffering spaces 420, respectively.

The first outer wall plate section 31, the first spacer plate section 32, the first inner wall plate section 33, and the first press plate section 34 of each first side plate 3 are folded relative to each other substantially at right angles. During folding of the first side plates 3, the connecting walls 42 are placed within the respective first side plates 3. The fastening tongues 35 are inserted into the respective insert holes 36. As such, the first side plates 3 are formed into a pair of the hollow side panels 43 of the packaging cushion 4 each confining the respective buffering space 30. The connecting walls 42 serve to connect the side panels 43 to the side panels 41.

Figure 1:
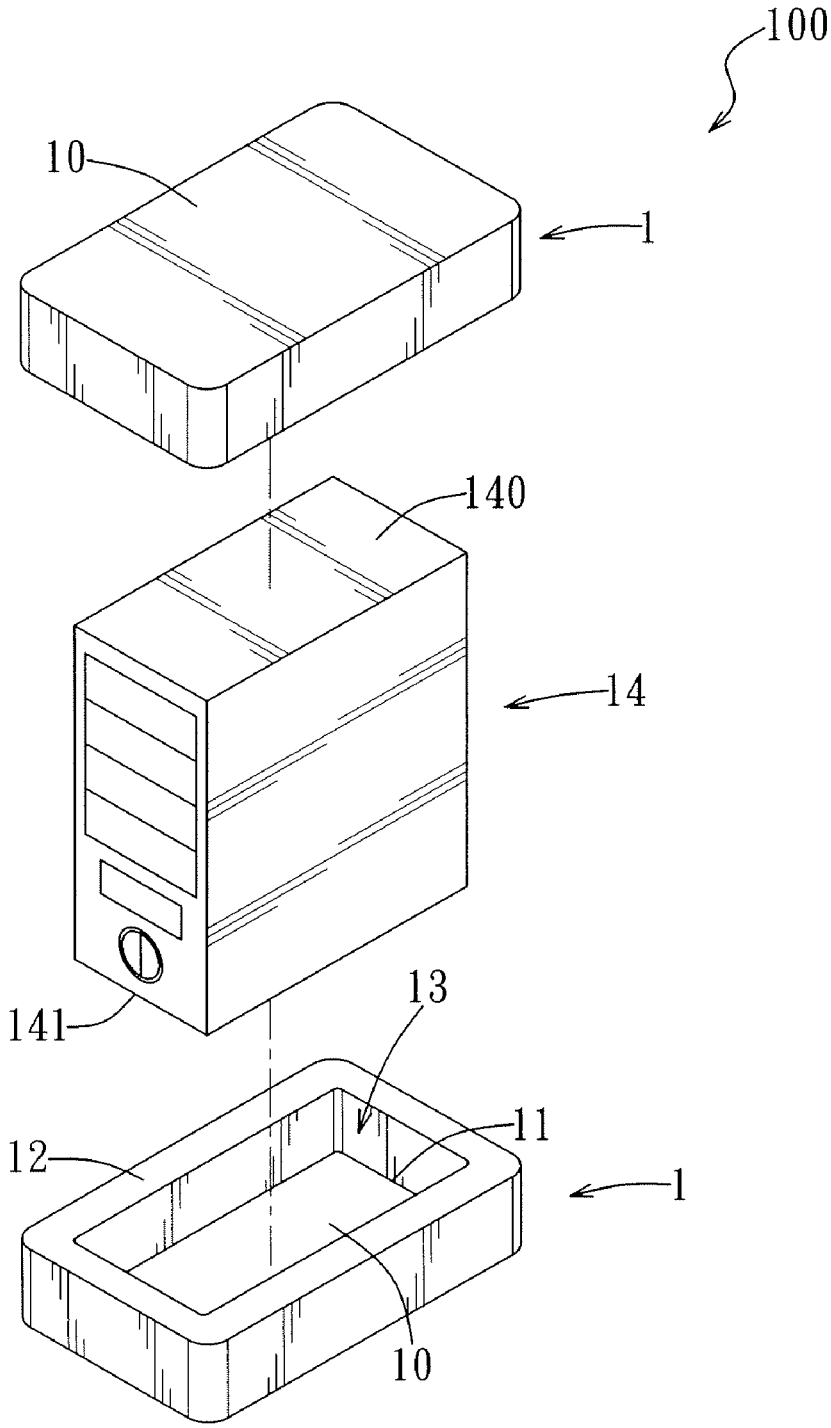
FIG. 1 PRIOR ART
FIG. 1 is a perspective view of a conventional packaging cushion assembly.

As an example of an application of the packing cushions 4, a computer module 14 is cushioned at top and bottom ends 140, 141 there of by a pair of the packaging cushions 4 (only one is shown in FIG. 4) before being packed into a packaging box (not shown). In particular, the bottom end 141 of the computer module 14 is fitted into the embracing space 40 of the packaging cushion 4 that acts like the conventional unitary molded cushion body 1 (see FIG. 1) made of foam. The top end 141 of the computer module 14 is similarly fitted into the other packaging cushion 4. The buffering spaces 30, 30' in the packaging cushion 4 serve to protect the computer module 14 from impact.

Figure 5:
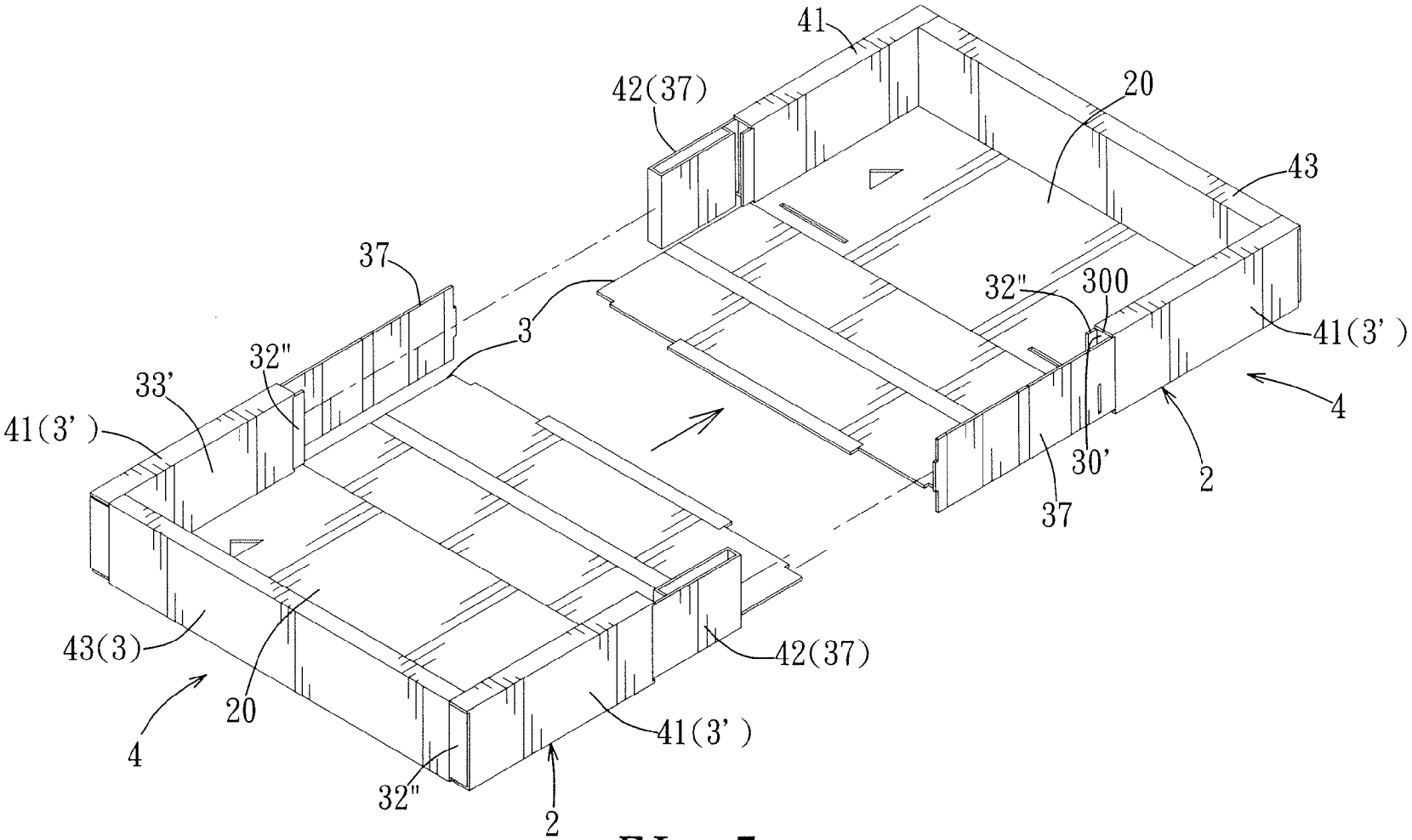
FIG. 5 is an exploded perspective view showing a pair of the packaging plates of the packaging cushion assembly, illustrating how the packaging plates are to be assembled together according to the present invention.
Figure 6:
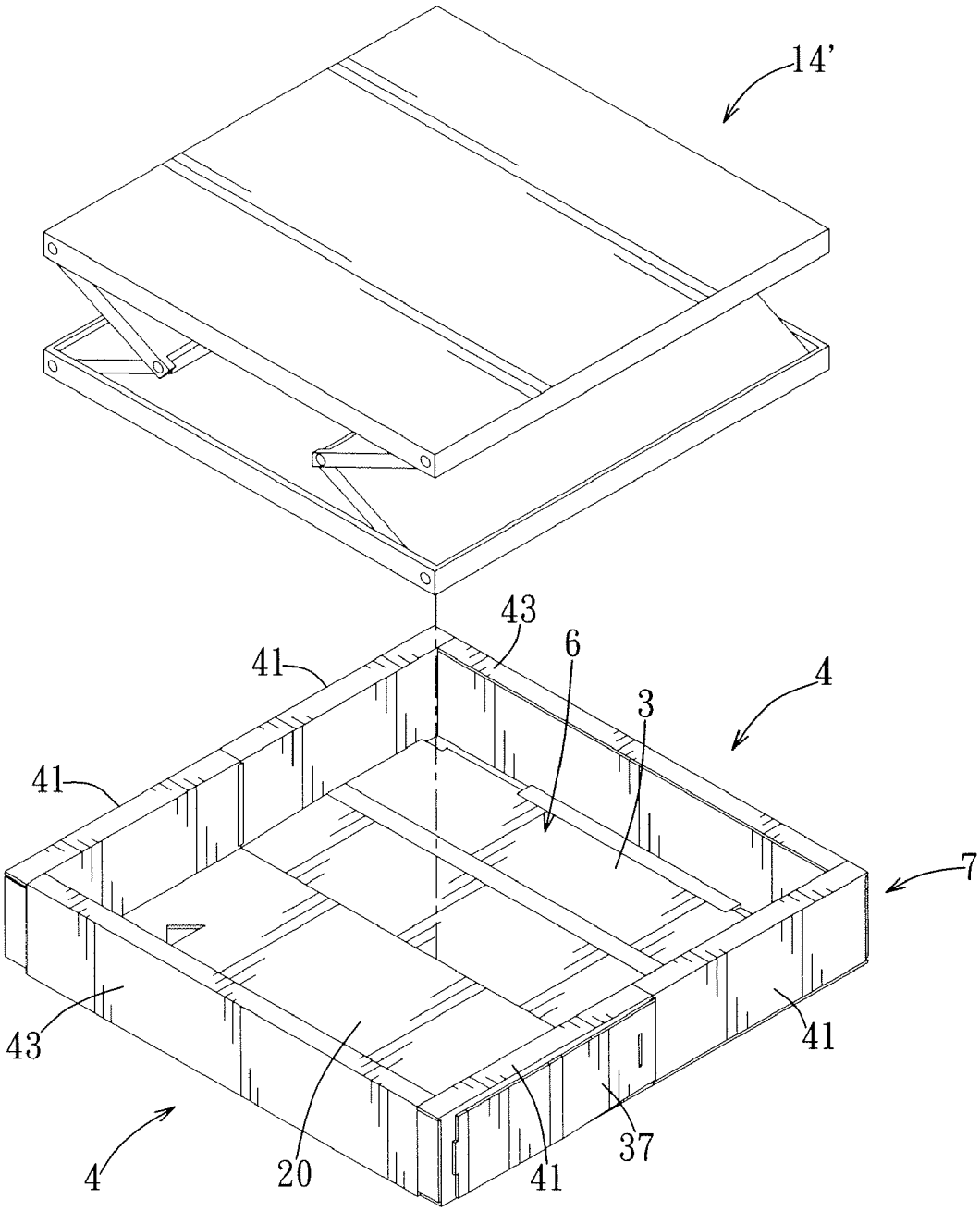
FIG. 6 shows the packaging plates of FIG. 5 after they are assembled together.

Referring to FIGS. 5 and 6, a pair of the packaging cushions 4 formed from a pair of the packaging plates 2 are interconnected to form a large cushion 7 for cushioning an empty folded computer case 14'. In each of the packaging plates 2, the two second side plates 3' and one of the first side plates 3 are folded, and the other first side plate 3 is unfolded. In particular, the two packaging plates 2 are overlapped, and the unfolded first side plate 43 of the packaging plate 2 provided at the left side is laid over the base plate 20 of the packaging plate 2 provided at the right side. One of the two connecting plates 37 of each packaging plate 2 adjacent to the unfolded first side plate 3 is unfolded, and the other one of the connecting plates 37 adjacent to the unfolded first side plate 3 is folded. The folded and unfolded connecting plates 37 extend in the same direction as the folded second side plates 3', respectively, as best shown in FIG. 5. One end wing 32" of each second inner plate section 33' is turned outwardly to open the respective buffering space 30', so that the buffering space 30' has an insert opening 300. The two packaging plates 2 are positioned adjacent to each other so that the folded connecting plate 37 (connecting wall 42) of each packaging plate 2 is aligned with the insert opening 300 of the other packaging plate 2. When the packaging plates 2 are pushed toward each other, the folded connecting plate 37 of each packaging plate 2 is inserted into the respective insert opening 300 of the other packaging plate 2. The packaging plates 2 are thus interconnected, thereby forming the large cushion 7, as best shown in FIG. 6. At this time, the unfolded first side plate 3 of one of the packaging plates 2 is disposed on top of the base plate 20 of the other one of the packaging plates 2, while the unfolded first side plate 3 of the other one of the packaging plates 2 extends over a bottom side of the base plate 20 of the other packaging plate 2. A large receiving space 6 is defined by the large cushion 7. A large article, such as the empty folded computer case 14', can be received and protected in the large receiving space 6.

While the present invention has been described in connection with what is considered the most practical and preferred embodiment, it is understood that this invention is not limited to the disclosed embodiment but is intended to cover various arrangements included within the spirit and scope of the broadest interpretation so as to encompass all such modifications and equivalent arrangements.

We claim:

1. A packaging cushion assembly comprising:

at least one foldable packaging plate including a base plate that has two opposite first sides and two opposite second sides, two opposite first side plates connected respectively and foldably to said first sides, and two opposite second side plates connected respectively and foldably to said second sides;

each of said first side plates having a first outer wall plate section connected foldably to the respective one of said first sides of said base plate, a first spacer plate section connected foldably to said first outer wall plate section opposite to said base plate, and a first inner wall plate section connected foldably to said first spacer plate section opposite to said first outer wall plate section and having substantially the same width as said first outer wall plate section;

each of said second side plates having a second outer wall plate section connected foldably to the respective one of said second sides of said base plate, a second spacer plate section connected foldably to said second outer wall plate section opposite to said base plate, and a second inner wall plate section connected foldably to said second spacer plate section opposite to said second outer wall plate section and having substantially the same width as said second outer wall plate section;

said second outer wall plate section of each of said second side plates having two ends that are opposite along a respective one of said second sides, and two connecting plates respectively and foldably connected to said two ends, each of said connecting plates having a third outer wall plate section connected foldably to said second outer wall plate section, a third spacer plate section connected foldably to said third outer wall plate section opposite to said second outer wall plate section, and a third inner wall plate section connected foldably to said third spacer plate section opposite to said third outer wall plate section; and said third spacer plate section and said third inner and outer wall plate sections being substantially rectangular, said third inner and outer wall plate sections being substantially parallel to each other and at right angle to said third spacer plate section when each of said connecting plates is folded so that a buffering space is formed between said third inner and outer wall plate sections.

2. The packaging cushion assembly of claim 1, wherein each of said first and second side plates, when folded, is formed into a hollow side panel that confines a buffering space.

3. The packaging cushion assembly of claim 2, wherein all of said first and second side plates are folded, each of said connecting plates being folded and inserted into said buffering space of an adjacent one of said hollow side panels so that said hollow side panels are interconnected.

4. A packaging cushion assembly comprising:

a pair of foldable packaging plates connectable to each other and each including a base plate that has two opposite first sides and two opposite second sides, two opposite first side plates connected respectively and foldably to said first sides, and two opposite second side plates connected respectively and foldably to said second sides;

each of said first side plates having a first outer wall plate section connected foldably to the respective one of said first sides of said base plate, a first spacer plate section connected foldably to said first outer wall plate section opposite to said base plate, and a first inner wall plate section connected foldably to said first spacer plate section opposite to said first outer wall plate section and having substantially the same width as said first outer wall plate section;

each of said second side plates having a second outer wall plate section connected foldably to the respective one of said second sides of said base plate, a second spacer plate section connected foldably to said second outer wall plate section opposite to said base plate, and a second inner wall plate section connected foldably to said second spacer plate section opposite to said second outer wall plate section and having substantially the same width as said second outer wall plate section;

said second outer wall plate section of each of said second side plates having two ends that are opposite along a respective one of said second sides, and two connecting plates respectively and foldably connected to said two ends, each of said connecting plates having a third outer wall plate section connected foldably to said second outer wall plate section, a third spacer plate section connected foldably to said third outer wall plate section opposite to said second outer wall plate section, and a third inner wall plate section connected foldably to said third spacer plate section opposite to said third outer wall plate section;

said two second side plates and one of said first side plates of each of said packaging plates being folded to form hollow side panels, respectively, each of said hollow side panels confining a buffering space;

the other one of said first side plates of each of said packaging plates is unfolded and laid over said base plate of the other one of said packaging plates; and one of said connecting plates adjacent to said first side plate that is unfolded in one of said packaging plates is folded and inserted into one of said hollow side panels adjacent to said first side plate that is unfolded in the other one of said packaging plates.

5. The packaging cushion assembly of claim 4, wherein the other one of said connecting plates adjacent to said first side plate that is unfolded in one of said packaging plates is unfolded to extend over one of said hollow side panels adjacent to said first side plate that is unfolded in the other one of said packaging plates.

6. A packaging cushion assembly comprising:

at least one foldable packaging plate including a base plate that has two opposite first sides and two opposite second sides, two opposite first side plates connected respectively and foldably to said first sides, and two opposite second side plates connected respectively and foldably to said second sides;

each of said first side plates having a first outer wall plate section connected foldably to the respective one of said first sides of said base plate, a first spacer plate section connected foldably to said first outer wall plate section opposite to said base plate, a first inner wall plate section connected foldably to said first spacer plate section opposite to said first outer wall plate section and having substantially the same width as said first outer wall plate section, and a first fastening tongue projecting from said first inner wall plate section;

each of said second side plates having a second outer wall plate section connected foldably to the respective one of said second sides of said base plate, a second spacer plate section connected foldably to said second outer wall plate section opposite to said base plate, a second inner wall plate section connected foldably to said second spacer plate section opposite to said second outer wall plate section and having substantially the same width as said second outer wall plate section, and a second fastening tongue projecting from said second inner wall plate section;

said base plate further having a first insert hole that is spaced apart from the respective one of said first sides to receive said first fastening tongue of the respective one of said first side plates, and a second insert hole that is spaced apart from the respective one of said second sides to receive said second fastening tongue of the respective one of said second side plates; and said second outer wall plate section of each of said second side plates having two ends that are opposite along a respective one of said second sides, and two connecting plates respectively and foldably connected to said two ends, each of said connecting plates having a third outer wall plate section connected foldably to said second outer wall plate section, a third spacer plate section connected foldably to said third outer wall plate section opposite to said second outer wall plate section, a third inner wall plate section connected foldably to said third spacer plate section opposite to said third outer wall plate section, a third fastening tongue projecting from said third inner wall plate section, and a third insert hole that is provided proximate to said second outer wall plate section to receive said third fastening tongue of the respective one of said connecting plates.

7. The packaging cushion assembly of claim 6, wherein each of said second side plates further has two end wings projecting outwardly and respectively from two opposite ends of said second inner wall plate section.

* * * * *